US006267841B1

(12) United States Patent
Burton

(10) Patent No.: US 6,267,841 B1
(45) Date of Patent: Jul. 31, 2001

(54) LOW ENERGY THERMOMECHANICAL PULPING PROCESS USING AN ENZYME TREATMENT BETWEEN REFINING ZONES

(76) Inventor: Steven W. Burton, 4655 Francisco Rd., Pensacola, FL (US) 32504

( * ) Notice: Subject to any disclaimer, the term of this patent is extended or adjusted under 35 U.S.C. 154(b) by 0 days.

(21) Appl. No.: 08/395,170

(22) Filed: Feb. 27, 1995

Related U.S. Application Data

(63) Continuation-in-part of application No. 08/176,299, filed on Jan. 3, 1994, now abandoned, which is a continuation of application No. 07/944,538, filed on Sep. 14, 1992, now abandoned.

(51) Int. Cl.[7] ..... D21B 1/12; D21H 11/20

(52) U.S. Cl. ..... 162/24; 162/25; 162/28; 162/72; 162/78; 162/83; 162/90

(58) Field of Search ..... 162/72, 23, 24, 162/25, 26, 28, 83, 78, 90; 435/277, 278

(56) References Cited

U.S. PATENT DOCUMENTS

| | | | | |
|---|---|---|---|---|
| 3,021,253 | * | 2/1962 | Opderbeck et al. | 162/72 |
| 3,406,089 | * | 10/1968 | Yerkes, Jr. | 162/72 |
| 3,962,033 | * | 6/1976 | Eriksson et al. | 162/72 |
| 4,145,246 | * | 3/1979 | Goheen et al. | 162/83 |
| 4,235,665 | * | 11/1980 | Reinhall et al. | 162/28 |
| 5,129,987 | * | 7/1992 | Joachimides et al. | 162/28 |

FOREIGN PATENT DOCUMENTS

2030186 * 5/1991 (CA) .

OTHER PUBLICATIONS

Leatham et al, "Energy Savings in Biochemical Pulping"; 4th Int Conf on Biotech. in Pulp & Paper Ind; Raleigh, N.C. 1989.*

* cited by examiner

*Primary Examiner*—Steve Alvo

(57) ABSTRACT

A low energy thermomechanical pulping process which employs an enzyme treatment stage between two low energy thermomechanical stages.

10 Claims, 1 Drawing Sheet

LOW ENERGY THERMOMECHANICAL PULPING PROCESS USING AN ENZYME TREATMENT BETWEEN REFINING ZONES

This application is a continuation-in-part of Ser. No. 08/176,299, filed Jan. 3, 1994, now abandoned, which is a continuation of Ser. No. 07/944,538, filed Sep. 14, 1992, now abandoned.

FIELD OF THE PRESENT INVENTION

The present invention relates to a process for producing high yield thermomechanical pulp with low energy requirements.

BACKGROUND OF THE PRESENT INVENTION

In the manufacture of paper from wood, the wood is first reduced to an intermediate stage in which the wood fibers are separated from their natural environment and transformed into a viscous liquid suspension known as a pulp. There are several classes of techniques which are known, and in general commercial use, for the production of pulp from various types of wood. The simplest in concept of these techniques is the so-called refiner mechanical pulping (RMP) method, in which the input wood is simply ground or abraded in water through a mechanical milling operation until the fibers are of a defined desired state of freeness from each other. Other pulping methodologies include: thermomechanical pulping (TMP); chemical treatment with thermomechanical pulping (CTMP); chemi-mechanical pulping (CMP); the so-called kraft or sulfate process for pulping wood; biomechanical pulping (BMP); and sulfite-modified thermomechanical pulping (SMTMP).

These methods are also described in the patent literature. For example, Goheen et al., U.S. Pat. No. 4,145,246 teach that sulfite-modified thermomechanical pulps (SMTMP) can be formed by subjecting the lignocellulose to multistage mechanical attrition, the first stage being conducted at elevated temperature and pressure and the second stage being run under atmospheric conditions wherein a sulfite chemical is added to the lignocellulose prior to the second stage to sulfonate the lignocellulose so that a percent bound sulfur level of at least about 0.15% is provided.

Blanchette et al., U.S. Pat. No. 5,055,159 teach that biomechanical pulps (BMP) can be formed by using biological processes as a pretreatment step. The patentees disclose using a species of fungus, ceriporiopsis subvermispora, to partially digest the wood followed by mechanical pulping.

Thermomechanical pulping is also well known in the prior art. For example, Asplund, U.S. Pat. No. 2,008,898 disclose presteaming wood chips to a suitable temperature above 100° C. and a corresponding pressure and refining at these conditions. Thermomechanical pulping has further been described in the literature as a process wherein the initial refining step takes place at a temperature above 140° C., the lignin portion of the undelignified lignocellulose is softened so that the wood structure is broken in the lignin-rich middle lamella layer and the cellulose fibers are easily separated from each other in a substantially undamaged condition at a relatively low consumption of energy. However, subsequent fibrillation of the pulp to make the pulp useful for printing paper grades requires large amounts of energy, since, when the fibers are released intact, they are coated with the softened lignin, which on cooling reverts to a glassy state and is only, with difficulty, subsequently fibrillated. Further, the refining also causes substantial fiber length reduction thereby providing poor strength properties of the resulting product.

Imparting large amounts of power, i.e. about 55 horsepower days per ton (hpd/t), during high temperature refining has been suggested in order to make the lignin coated fibers more easily refinable. However, although such a high energy process improves fiber separation, it also causes destruction or damage to or delamination of the fiber layers themselves, thereby exposing the cellulose-rich inner surfaces to further mechanical treatment. This results in a significant reduction in the average fiber length and a concurrent reduction of strength properties.

Accordingly, none of the prior art processes teach a pulping method which produces a high yield pulp with low energy requirements. To this end, it has been found that a high yield thermomechanical pulp with low energy requirements can be obtained by the process of the present invention, thereby satisfying a long felt need in the art.

SUMMARY OF THE PRESENT INVENTION

According to the present invention, there is provided a method for pulping wood chips comprising the steps of: (a) feeding the wood chips to a primary refiner zone operating at a temperature of above about 150° C. and at an energy level of less than about 10 hpd per ton; (b) treating the pulp from step (a) with an enzyme; and (c) further refining the treated pulp in a second refiner zone operating at an energy level of less than 20 hpd per ton. Preferably, the secondary refiner operates at a temperature of about 100° C.

In other preferred embodiments, the chips are pretreated prior to primary refining and the enzymes comprise pectinase, xylanase, laccase, cellulase or mixtures thereof.

DETAILED DESCRIPTION OF THE PRESENT INVENTION

Figure 1:
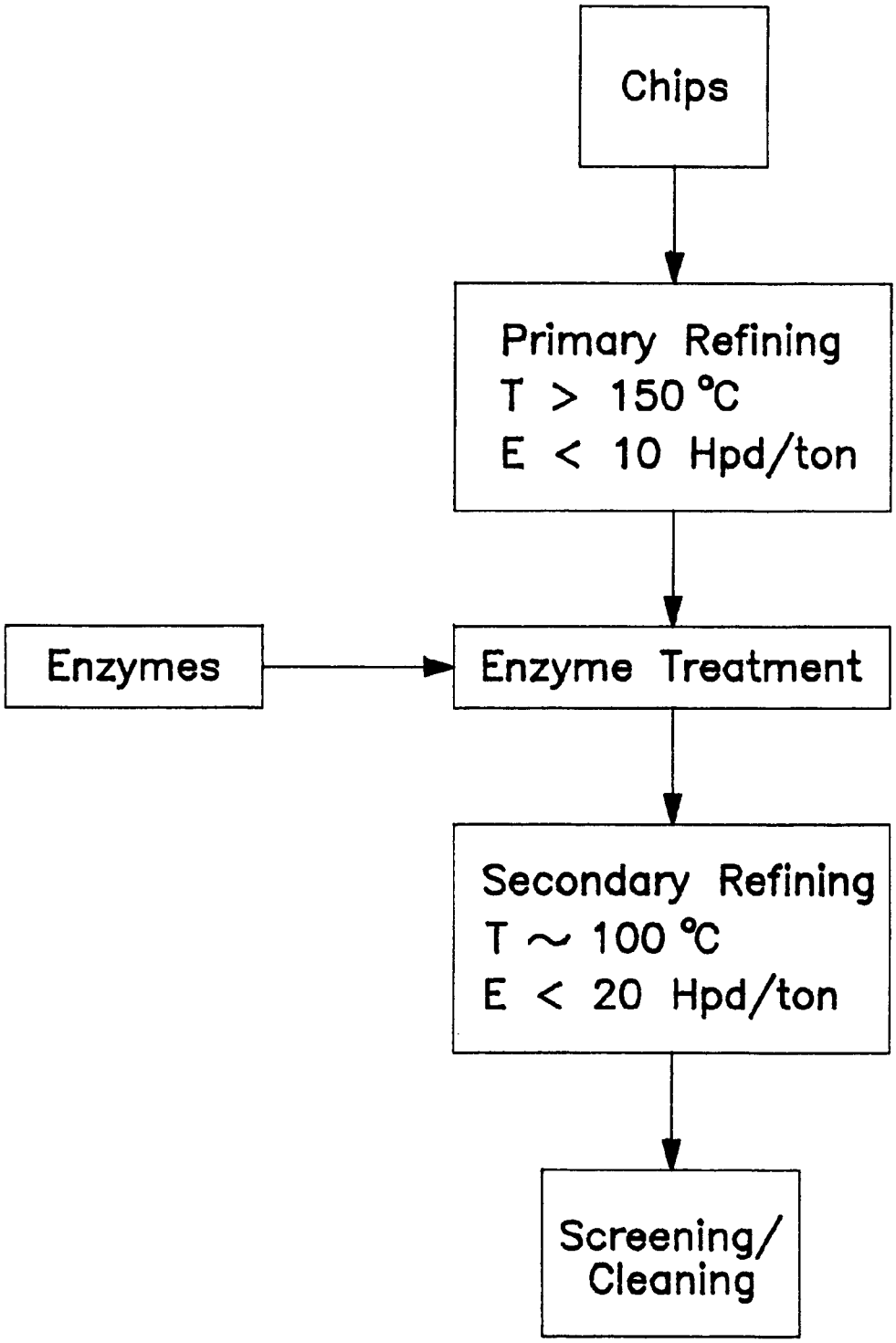
FIG. 1 depicts, in flow chart form, the process of the present invention.

The present invention provides a novel process for producing high yield, high strength thermomechanical pulp with low energy requirements.

In its broadest sense, the method of the present invention comprises a three step process for pulping wood chips, comprising a primary refining step, an enzyme treatment step, and a secondary refining step.

It is further contemplated that the wood chips can be pretreated by means known to those skilled in the art prior to the primary refining step. This includes preheating; steaming; diluting; chemical pretreatments with chemicals such as hydrogen peroxide, sodium sulfite or sodium hydroxide; enzyme pretreatment; fungal pretreatment; and/or mechanical pretreatment for chip destructuring.

The optionally pretreated chips are then fed to a primary refiner, in the presence of dilution water.

Suitable materials from which the wood chips can be derived for use herein include the usual species of coniferous pulp wood such as spruce, hemlock, fir, pine and the like; deciduous pulp wood such a poplar, birch, cottonwood, alder, etc.; and fibrous plants used in papermaking, exemplified by cereal straws, corn stalks, bagasse, grasses and the like. The chips may range in size from about 0.125 inches to about 0.75 inches, but most preferably are in the range of about 0.25 inches.

The chips are heated to a temperature in excess of the thermal softening point for lignin, from about 145° C. to about 175° C., preferably less than about 150° C., and refined by defibering in a conventional refiner at an energy level of less than 10 hpd per ton. The temperature for the softening is dependent on the wood species and the pretreatment conditions. this low energy primary defibering process is similar to the commercial processes used in producing fiber insulating board material. Typically, any device capable of imparting attrition at the desired temperature and pressure conditions can be employed as a means for conducting the initial mechanical attrition step. Generally, however, a disc or conical refiner is employed. Preferably the refiner is a steam-pressured disc-refiner or double-disc-refiner, such as, for example, a Bauer Model No. 418 pressured double-disc-refiner made by the Bauer Bros. Co. of Springfield, Ohio.

The low energy refined pulp is then withdrawn from the primary refiner and passed to an enzyme treatment zone wherein it is treated with a series of enzymes to weaken the fiber casing. Preferred enzymes include pectinase, xylanase, laccase, cellulase, manganese peroxidase, and mixtures of any of the foregoing. Preferably the amount of enzymes employed ranges from about 0.5 AU/gm. OD pulp to about 20 AU/gm. OD pulp, most preferably from about 2 AU/gm. OD pulp to about 7 AU/gm. OD pulp. The temperature, at atmosphere pressure, range in the enzyme treatment steps are 40° C. to 65° C. and is dependent on the particular enzyme used. The PH in the enzyme treatment zone is enzyme dependent and ranges generally from 4 to 8, while the consistency of the pulp is maintained in a range from 3% to 15%. The time of treatment ranges from 30 minutes to eight hours and is selected so as to avoid fiber damage. In the case of cellulase enzyme, the treatment time is limited to a range from 30 minutes to one hour due to the potential for fiber damage if the treatment time is extended.

The treated pulp is then fed to a secondary refiner which operates at an energy level of less than about 20 hpd per ton, and at a temperature of about 100° C. Preferred devices for secondary refining are the atmospheric disc or conical refiner.

The pulp exiting from the secondary refiner is then screened and cleaned according to conventional procedures. The product pulp is produced employing reduced energy, and has enhanced strength and improved bleaching.

The overall energy efficiency of the process of the present invention can be compared to other pulping processes of the prior art, i.e. a straight mechanical process, a thermomechanical process, a biomechanical process or a chemimechanical process by pulping the same chips and at the same time monitoring the energy consumption of the refining itself. It will be found that the enzyme treated chips pulped according to the process of the present invention require significantly less energy input through the refiner to achieve the same level of freeness in the resulting pulps.

Further, the average length of the lignocellulosic fiber in the pulps of the present invention is maintained at a greater length than fibers in pulps prepared according to the processes of the prior art. Thus, the pulps of the present invention also have improved strength over those of the prior art.

The pulps made in accordance with the present invention may then be made into a wide variety of paper products using standard paper making techniques. It has been found that the standard techniques as described by the Technical Association of the Paper and Pulp Industry (TAPPI) which are known to work with mechanically refined pulps work equally well with the pulps prepared in accordance with the present invention. Accordingly, the paper may be made using conventional methodologies. The paper prepared form the pulps of the present invention compares favorably in quality, strength and texture to papers prepared from the pulps of the prior art.

Thus, the present invention provides a process for producing pulps which not only results in significant savings in energy requirements, but also provides a pulp which has improved paper making qualities.

The above-referenced patents are all hereby incorporated by reference.

Many variations of the present invention will suggest themselves to those of ordinary skill in the art in light of the above-detailed description. All such obvious modifications are within the full intended spirit and scope of the appended claims.

What is claimed is:

1. A method for pulping wood chips comprising the steps of:

(a) feeding the wood chips to a primary refiner zone operating at a temperature of above about 145° C. and at an energy level of less than about 10 hpd per ton for a time to cause substantive separation of wood fiber comprising said wood chips without causing substantial reduction in the average length of said wood fibers to form pulp comprising said wood fiber having a lignin coating on an outer surface of said fiber;

(b) treating the pulp form step (a) with an enzyme in the substantial absence of treatment chemicals in an amount and for a time sufficient to weaken the strength of the lignin coating to form treated pulp; and (c) further refining the treated pulp in a second refiner zone operating at an energy of less than about 20 hpd per ton to form a processed pulp comprising wood fiber having a reduced amount of lignin coating wherein the average length of said wood fiber is at least about 80% of the average length of wood fiber in said wood chips.

2. A method as defined in claim 1 wherein step (a) is carried out at a temperature ranging from about 145 to about 155° C.

3. A method as defined in claim 1 wherein the wood chips are pretreated prior to step (a).

4. A method as defined in claim 3 wherein the pretreatment of the wood chips comprises chemical, mechanical, enzyme or biological pretreatment.

5. A method as defined in claim 4 wherein said chemical pretreatment comprises pretreating with hydrogen peroxide, sodium sulfite, sodium hydroxide or a mixture of any of the foregoing.

6. A method as defined in claim 1, wherein said enzyme treatment step (b) comprises the addition of an enzyme selected from pectinase, xylanase, laccase, manganese peroxidase, cellulase, or mixtures of any of the foregoing.

7. A method as defined in claim 1 wherein said enzyme pretreatment step (b) is carried out at a temperature ranging from about 40° C. to about 65° C.

8. A method as defined in claim 1 wherein said second refining step (c) is carried out at a temperature of about 100° C. and at an energy level less than 20 hpd per ton.

9. A method of claim 1 wherein the average length of wood fiber comprising said processed pulp is at least about 90% of the average length of wood fiber in said wood chips.

10. A method of claim 1 wherein the average length of wood fiber comprising said process pulp is substantially the same as the average length of wood fiber in said wood chips.

* * * * *